US009987644B1

(12) United States Patent
Anderson, Jr.

(10) Patent No.: US 9,987,644 B1
(45) Date of Patent: Jun. 5, 2018

(54) PEDESTAL CHIP MOUNT FOR FLUID DELIVERY DEVICE

(71) Applicant: Funai Electric Co., Ltd., Osaka (JP)

(72) Inventor: James D. Anderson, Jr., Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days. days.

(21) Appl. No.: 15/371,632

(22) Filed: Dec. 7, 2016

(51) Int. Cl.
*B41J 2/175* (2006.01)
*B05B 9/04* (2006.01)
*B41J 2/14* (2006.01)

(52) U.S. Cl.
CPC ..... *B05B 9/0413* (2013.01); *B05B 15/65* (2018.02); *B41J 2/14* (2013.01); *B41J 2/1753* (2013.01); *B41J 2/1754* (2013.01); *B41J 2/17503* (2013.01); *B41J 2/17536* (2013.01)

(58) Field of Classification Search
CPC .... B05B 9/0413; B05B 15/065; B41J 2/1753; B41J 2/14; B41J 2/1754; B41J 2/17536; B41J 2/17503
See application file for complete search history.

(56) References Cited

U.S. PATENT DOCUMENTS

| | | | | |
|---|---|---|---|---|
| 5,751,324 | A * | 5/1998 | Brandon | B41J 2/14024 347/87 |
| 6,749,287 | B2 | 6/2004 | Osada et al. | |
| 7,570,494 | B2 | 8/2009 | Suzuki et al. | |
| 8,240,814 | B2 | 8/2012 | Saikawa et al. | |
| 8,979,246 | B2 | 3/2015 | Sakai et al. | |
| 9,457,570 | B2 | 10/2016 | Yamada | |
| 2012/0229572 | A1* | 9/2012 | Miyazaki | B41J 2/14024 347/50 |

* cited by examiner

*Primary Examiner* — Yaovi M Ameh
(74) *Attorney, Agent, or Firm* — Luedeka Neely Group, PC

(57) ABSTRACT

A fluid ejection head having a fluid supply body having a nosepiece with at least one fluid supply port. A pedestal extends outwards from the exterior of the nosepiece near the fluid supply port. A semiconductor chip mounting surface is formed on the pedestal. A flexible circuit bonding surface, formed by a plurality of ribs, also extends outwards from the exterior surface of the nosepiece adjacent the perimeter of the pedestal. A damage reducing structure for reducing damage to a semiconductor chip mounted on the pedestal is located between the pedestal and the flexible circuit bonding surface. Similarly, a damage reducing structure is located between each adjacent pair of the plurality of ribs. In each case, the damage reducing structure may be void space that isolates and reduces damage caused by shock waves traveling through the fluid supply body to the chip mounting surface and the chip mounted thereon.

18 Claims, 5 Drawing Sheets

PEDESTAL CHIP MOUNT FOR FLUID DELIVERY DEVICE

TECHNICAL FIELD

The disclosure relates to fluid ejection head structures and in particular to apparatus and method that are effective for reducing stresses and deformation in chips mounted on a fluid delivery device.

BACKGROUND AND SUMMARY

Fluid ejection heads for fluid ejection devices such as ink jet printers, vapor evaporation devices, and the like continue to be improved as the technology for making the ejection heads continues to advance. New techniques are constantly being developed to provide low cost, highly reliable fluid ejection head structures that can be manufactured in high yield with a relatively low amount of spoilage or ejection head damage.

In order to increase ejection head speed and volume output, larger ejection heads having an increased number of ejection actuators are being developed. However, as the ejection head size and number of ejection actuators increases, manufacturing apparatus and techniques are required to meet increased tolerance demands for such ejection heads. Slight variations in tolerances of parts may have a significant impact on the operation and yield of suitable ejection head products.

The primary components of the fluid ejection head are a chip or chip containing fluid ejector actuators, and a nozzle plate attached to the chip. The chip is typically made of silicon and contains various passivation layers, conductive metal layers, resistive layers, insulative layers and protective layers deposited on a device surface thereof. For thermal fluid ejection heads, individual heaters are defined in the resistive layers and each heater resistor corresponds to a nozzle hole in the nozzle plate for heating and ejecting fluid from the ejection head toward a target media. Fluid ejection heads may also include bubble pump type ejection head. In a top-shooter type ejection head, nozzle plates are attached to the chips and there are fluid chambers and fluid feed channels for directing fluid to each of the heaters or bubble pumps on the chip either formed in the nozzle plate material or in a separate thick film layer. In a center feed design for a top-shooter type ejection head, fluid is supplied to the channels and chambers from a slot or via that is conventionally formed by chemically etching or grit blasting through the thickness of the chip. The chip containing the nozzle plate is typically bonded to a thermoplastic body using a heat curable adhesive to provide a fluid ejection head structure.

The thermal cure process locks the components together at an elevated temperature. The heater chip has a relatively low coefficient of thermal expansion (CTE) while the plastic body has a relatively high CTE. Heating the components causes each one to expand according to their respective CTEs. As the parts cool and shrink, the higher CTE plastic body shrinks more than the lower CTE silicon heater chip resulting in thermal stresses on the chip. The force-deflection (spring rate) characteristics of the chip and body determine the equilibrium deflection of each part.

In order to address the issues related to thermal compression of the chip as the chip and plastic body cool, ceramic substrates have been attached to the chip. However, ceramic substrates substantially increase the cost of the ejection head. Silicon bridges in a via area of the chip have also been used, but such silicon bridges result in fluid flow problems in the chip via area.

It is believed that a predominant contributor of chip distortion and cracking is the coefficient of thermal expansion mismatch between the chip and the thermoplastic body. During manufacturing, when the chip and body go through the adhesive cure cycle, chip distortion is introduced as the components cool. Accordingly, there continues to be a need for improved manufacturing processes and techniques which provide improved ejection head components and structures without product loss due to chip cracking.

With regard to the above, there is provided a fluid ejection head having a fluid supply body having a nosepiece with at least one fluid supply port formed therein. A pedestal extends outwards from an exterior surface of the nosepiece proximate the at least one fluid supply port. The pedestal has a perimeter edge that, in some cases is dog-bone shaped. A semiconductor chip mounting surface is formed within the perimeter edge.

A flexible circuit bonding surface also extends outwards from the exterior surface of the nosepiece adjacent the perimeter edge of the pedestal. In certain cases, the pedestal has opposing side surfaces and opposing end surfaces and the flexible circuit bonding surface is adjacent each of the side and end surfaces of the pedestal. In other cases, the flexible circuit bonding surface may be located along only the sides of the pedestal.

A damage reducing structure is located between the perimeter edge of the pedestal and the flexible circuit bonding surface for reducing damage to a semiconductor chip mounted on the pedestal. In certain cases, the damage reducing structure is a void space. The void space isolates the pedestal from the surrounding flexible circuit bonding surface such that damaging shocks acting on the fluid supply body, such as those caused by drops, are reduced or eliminated prior to reaching the flexible circuit bonding surface and the chip that is mounted thereon. In other cases, the damage reducing structure may be a corrosion resistant compressible member, such as a silicone rubber.

In certain embodiments, the flexible circuit bonding surface includes a plurality of ribs. Preferably, the ribs (or a portion thereof) have a substantially planar top surface that is suitable for forming the flexible circuit bonding surface.

The length and thickness of the ribs may be varied as required to improve the isolation of the pedestal from the surrounding flexible circuit bonding surface but, at the same time, to provide for sufficient structural support for the chip and the fluid supply body in general. In certain embodiments, a mix of ribs including ribs having a first length and ribs having a second length may be used. For example, in certain embodiments, the pedestal has opposing side surfaces and opposing end surfaces and at least three ribs are located adjacent each side and at least two ribs are located adjacent each end of the pedestal. Additionally, the ribs may be oriented at different angles with respect to other ribs. For example, the fluid supply body may include a first rib and a second rib that is oriented at an angle $\Theta$ with respect to the first rib. The angle $\Theta$ may vary and, in certain cases, is greater than 0° and less than 180°. In other cases, $\Theta$ is greater than 45° and less than 135°.

Preferably, the ribs extending towards the pedestal do not contact the pedestal in order to maintain the isolation of the pedestal form the flexible circuit bonding surface. There is a damage reducing structure located between each adjacent pair of the plurality of ribs. In certain cases, the damage reducing structure is a void space. In other cases, the damage reducing structure may be a corrosion resistant compressible member, such as a silicone rubber.

BRIEF DESCRIPTION OF THE DRAWINGS

Further advantages of the disclosure may be apparent by reference to the detailed description of preferred embodiments when considered in conjunction with the following drawings, in which like reference numbers denote like elements throughout the several views, wherein features have been exaggerated for ease of understanding and are not intended to be illustrative of relative thicknesses of the features, and wherein.

DETAILED DESCRIPTION

Figure 1:
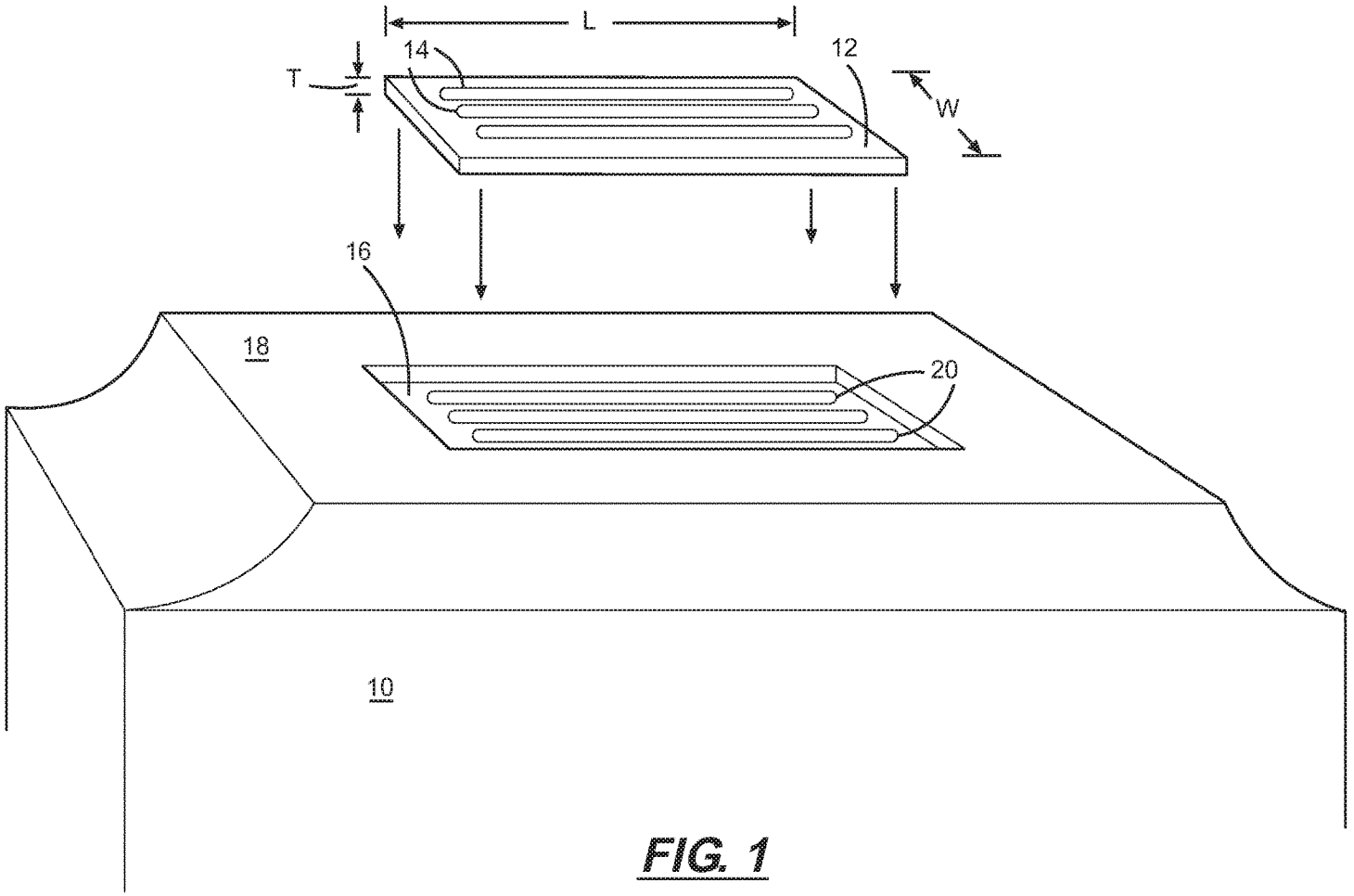
FIG. 1 Prior Art
FIGS. 1 and 2 are perspective views of portions of a prior art fluid ejection head.
Figure 2:
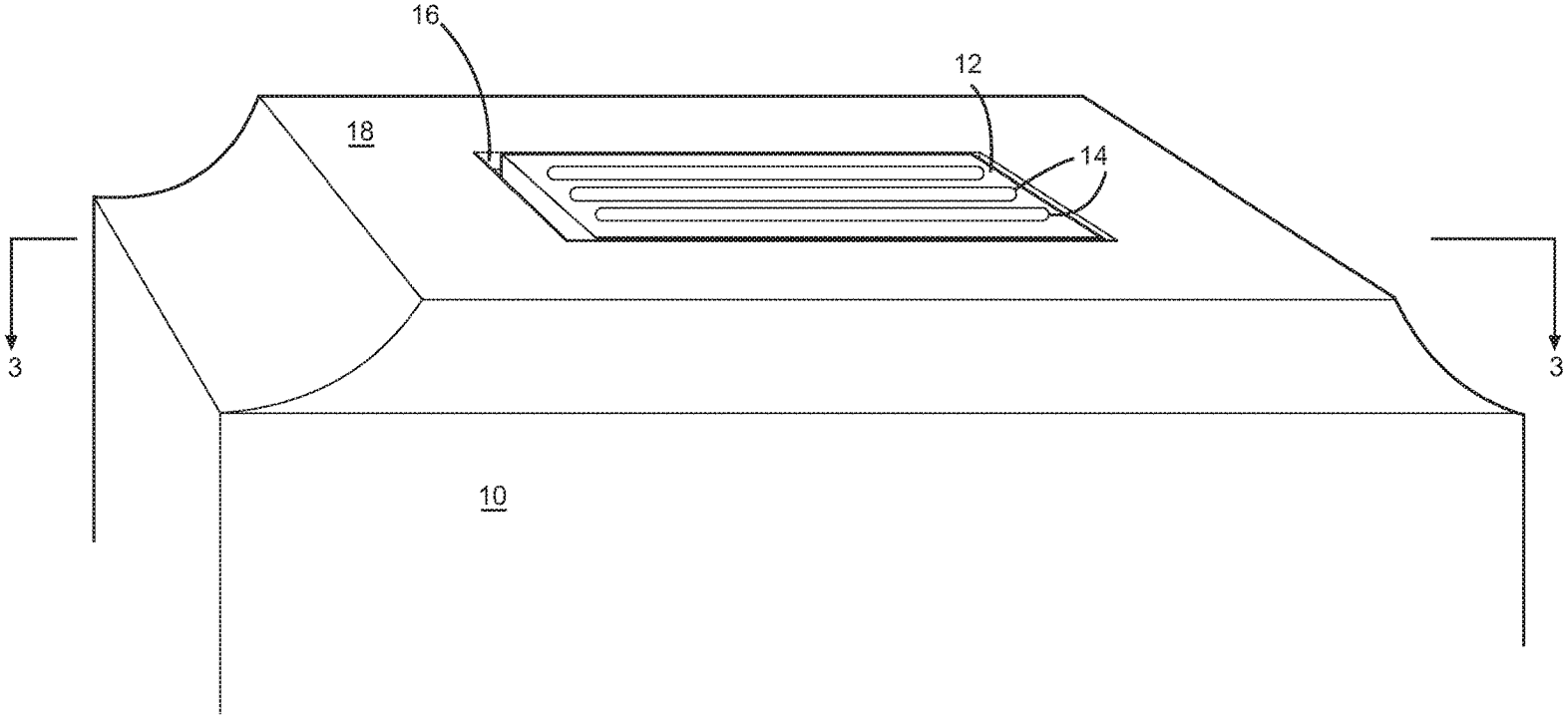
FIG. 2 Prior Art

Examples of prior art thermoplastic bodies 10 for providing fluid to be ejected by a fluid ejection head attached to the body are illustrated in FIGS. 1 and 2. For simplification purposes only, the term "chip" is intended to include a semiconductor chip containing fluid ejectors thereon and a nozzle plate attached to the chip that collectively provides a—fluid ejection head. Details of the fluid ejection head components are well known in the art and thus are not reproduced here. Of the components of the ejection head, the chip 12 is the most critical component. Chips 12 may be made of semiconductor or ceramic materials and are fragile compared to the body 10. Accordingly, care must be taken to assure that the chips are not damaged during assembly of the fluid ejection heads or during use. However, current designs provide inadequate protection for the chip and thus the chips are prone to damage. In the description that follows and appended claims, the term "damage" may refer to stress, including thermal stress or drop stress, shock, vibration, etc. that may adversely impact the performance of the chip of a fluid ejection head.

With reference to FIG. 1, the ejection head including the chip 12 is attached to the body 10 in a chip pocket 16 or recessed area in a surface 18 of the body 10. The chip 12 is relatively small and may have a length (L) of from about 10 to about 100 millimeters by from about 3 to about 10 millimeters in width (W) by from about 200 to about 800 microns in thickness (T). The chip 12 includes one or more fluid feed slots 14, defined by etching through the thickness T of the chip 12, for supplying fluid from the body 10 to ejection actuators on a device surface of the chip 12. In FIG. 1, three slots in the chip 14 are illustrated, however, the chip 12 may have more or fewer of the slots 14. The body 10 may be made of a polymeric material, such as amorphous thermoplastic polyetherimide materials, glass filled thermoplastic polyethylene terephthalate resin materials, syndiotactic polystyrene containing glass fiber, polyphenylene ether/polystyrene alloy resin and polyamide/polyphenylene ether alloy resin.

The chip is typically surrounded on all sides by the body 10 after being inserted into the chip pocket 16. For example, in FIGS. 1 and 2, the chip 12 is shown being placed into a standard rectangular pocket. The chip pocket 16 includes slots 20 for supplying fluid from the body 10 to the ejection head chip 12 corresponding to the slots 14 in the chip 12. It is important that the slots 20 in the chip pocket 16 remain aligned with the feed slots 14 formed in the chip in order to maximize performance of the chip 12. For that reason, a thermally curable adhesive is used to attach the chip 12 to the body 10 in the chip pocket 16 to provide the assembled structure illustrated in FIG. 2. The adhesive may be an epoxy adhesive. The thickness of adhesive in the chip pocket 16 may range from about 25 microns to about 250 microns. Heat is typically required to cure the adhesive and fixedly attach the chip 12 to the body 10 in the chip pocket 16.

The body 10 and the chip 12 often have different coefficients of thermal expansion (CTE). For example, the body 10 may have a coefficient of thermal expansion (CTE) of about 42 microns/meter per ° C. By contrast, the chip 12 may have a CTE of about 2 to about 3 microns/meter per ° C. Additionally, the adhesive used may have a different CTE from the body 10 or the chip 12. The different CTEs of the materials become important during a procedure for attaching the chip 12 to the body 10. During this process there may be a cure cycle temperature change of approximately 60°-80° C., which temperature change may cause thermal expansion of the chip 12, the body 10, and adhesive. Since the body 10 has an order of magnitude higher thermal expansion coefficient than the chip 12, shrinkage in the body 10 may be substantially greater than shrinkage of the chip 12 as the chip 12 and the body 10 cool. Similarly, the shrinkage rate of the adhesive may vary widely from the shrinkage rate of the body 10 or chip 12. Shrinkage of the body 10 may cause damage in the form of stress or deformation to the chip, the nozzle plate, etc., as one component shrinks quickly or to a larger degree while other components shrink slowly or to a lesser degree.

For the reasons above, the chip 12 is under some level of stress due simply to the manufacturing process. This inherent stress can add to the fragility of the chip. Since the chip 12 is already under stress, added stress or shock may damage to the chip 12, cause it to break or cause it to perform poorly. What is needed, therefore, is a method and apparatus for reducing the potential for damage to the chip 12 be reducing the amount stress placed on the chip during the manufacturing process and by also reducing the amount of stress that is transmitted to the chip as a result of drops, sudden impacts, etc.

Figure 3:
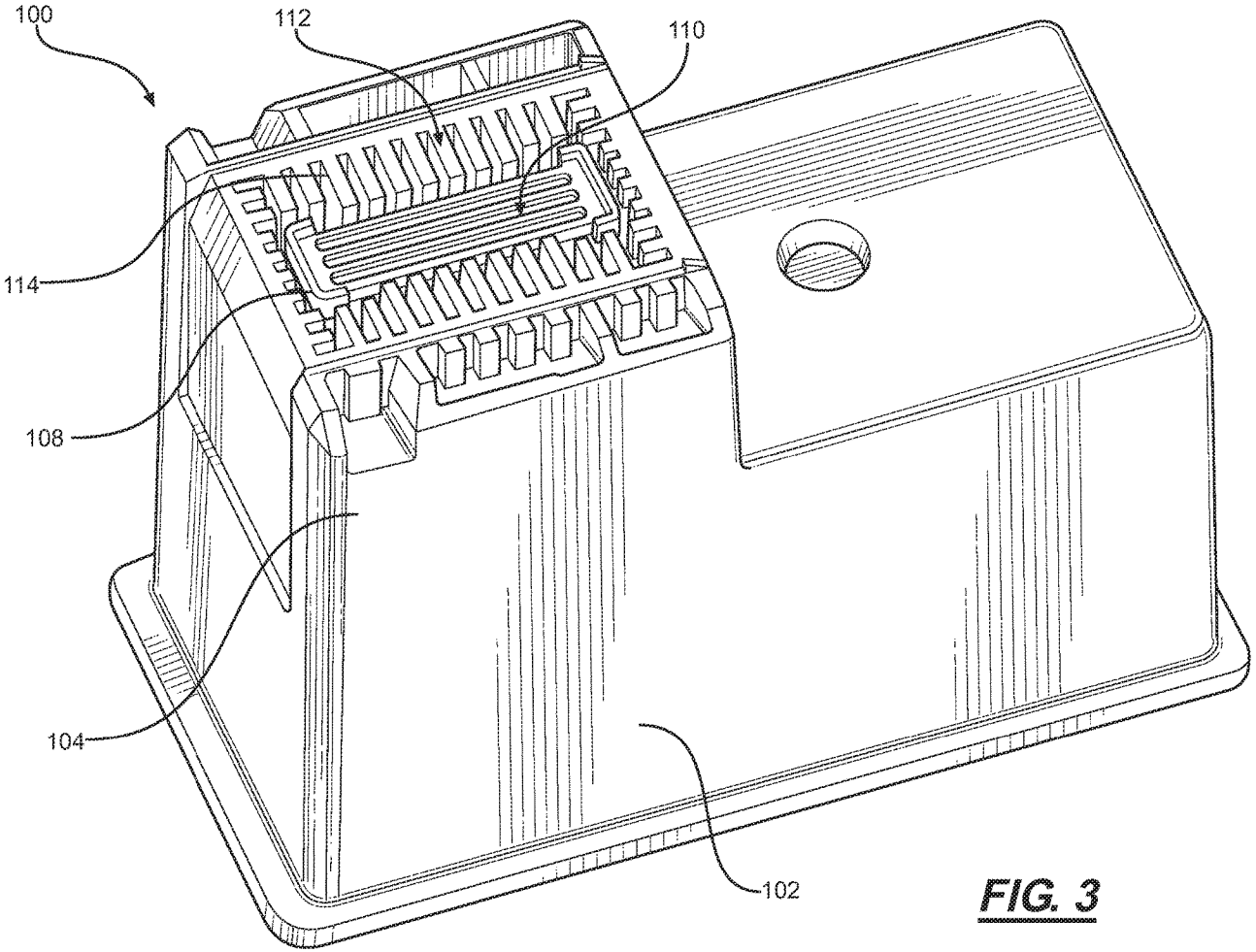
FIG. 3 is a perspective view of a fluid supply body having a pedestal chip mount surface according to an embodiment of the present disclosure.
Figure 4:
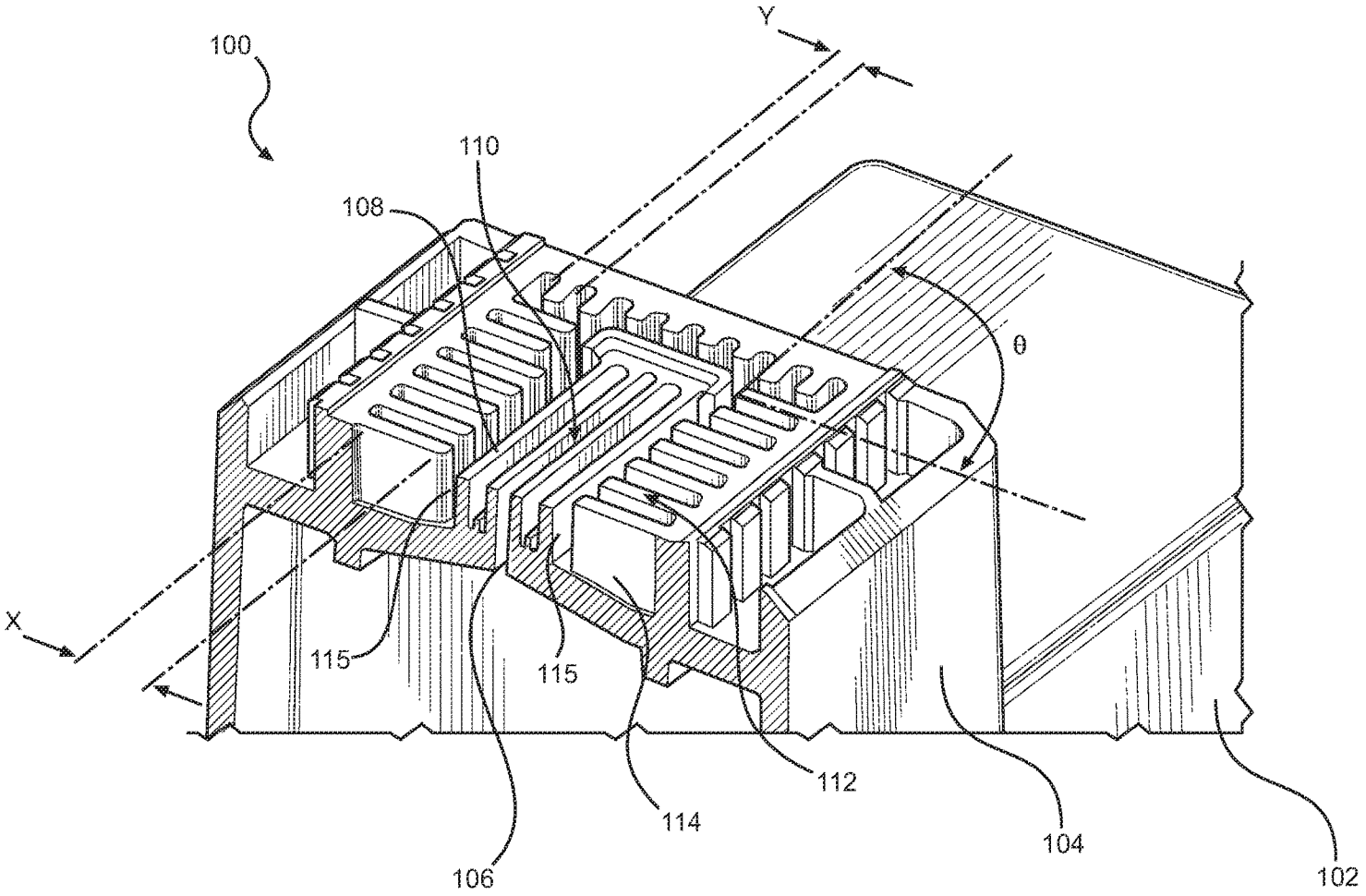
FIG. 4 is a cutaway view of a portion of the fluid supply body of FIG. 3 illustrating the pedestal chip mount surface.
Figure 5:
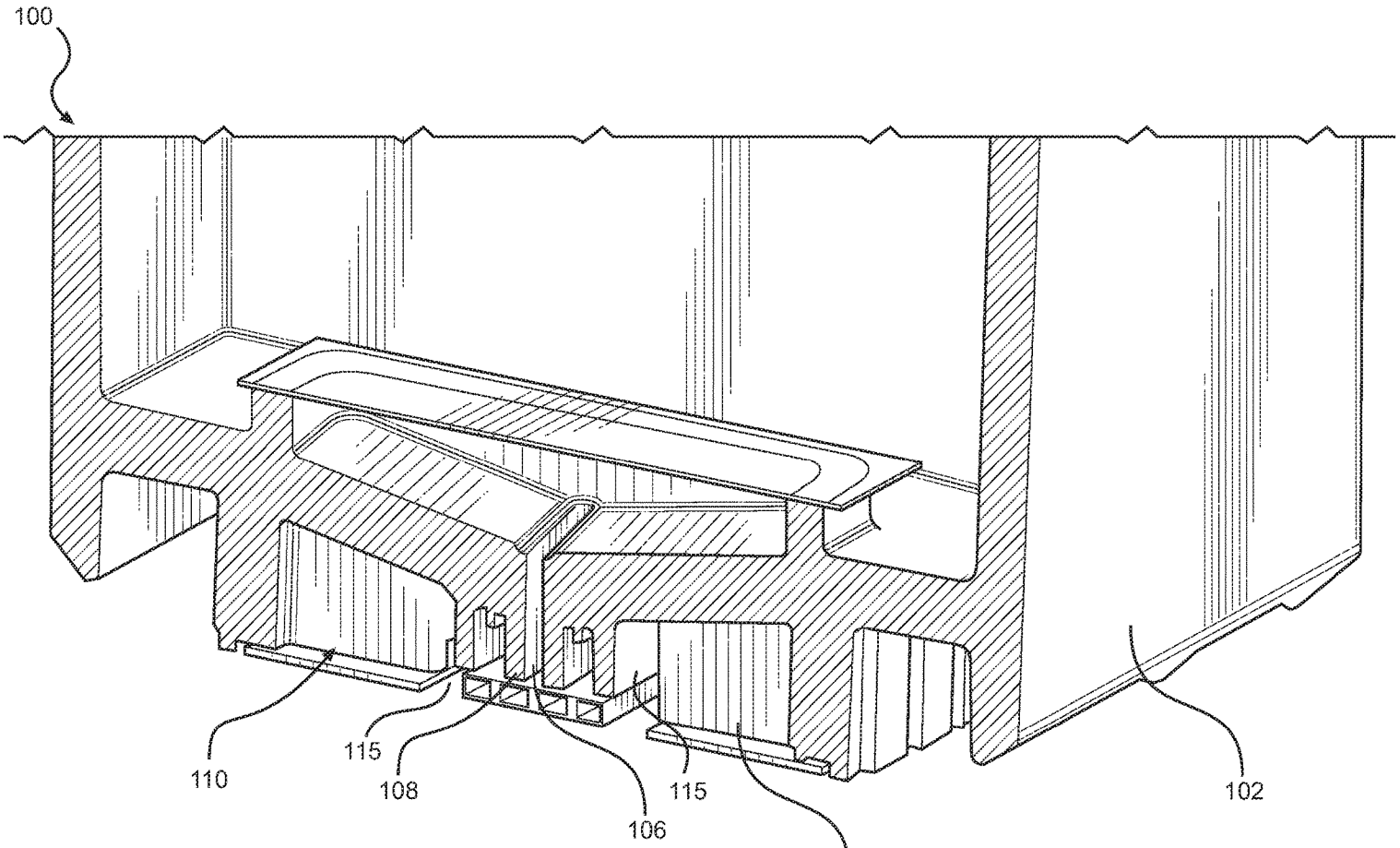
FIG. 5 is a cutaway view of a portion of the fluid supply body of FIG. 3 illustrating a filter and a filter tower within a cartridge body for the ejection head.

With reference now to FIGS. 3-5, there is provided a fluid ejection head 100 designed for reducing chip damage according to an embodiment of the present disclosure. The fluid ejection head 100 includes a fluid supply body 102 having a nosepiece 104 with at least one fluid supply port 106 formed therein. A pedestal 108 extends outwards from an exterior surface of the nosepiece 104 proximate the at least one fluid supply port 106. The pedestal 108 has a perimeter edge and there is a semiconductor chip mounting surface 110 formed within that perimeter edge. A semiconductor chip may be mounted onto the mounting surface 110 using the adhesive described above. In certain embodiments, the mounting surface 110 is somewhat dog-bone shaped. This shape minimizes the amount of plastic material that the chip is attached to along the sides, while maintaining a wide pocket on the ends for corrosion protection. The narrow areas along the length of the chip allow the strength of the plastic to be less than the strength of the chip. It also reduces the likelihood of adhesive climbing the sides of the chip, which has been shown to cause stresses in the chip, which in turn cause deflection in the nozzle plate. The ends being wider also allow for a larger pocket area to dispense adhesive which can be forced into the back side of the flexible circuit as a corrosion inhibitor.

Additionally, a flexible circuit bonding surface 112 extends outwards from an exterior surface of the nosepiece 104 adjacent the perimeter edge of the pedestal 108. In some embodiments, the flexible circuit bonding surface 112 is located only on opposing side surfaces of the pedestal. However, in other embodiments, the flexible circuit bonding surface 112 is located on opposing side surfaces of the pedestal as well as opposing end surfaces. A damage reducing structure 115 is located between the perimeter edge of the pedestal and the flexible circuit bonding surface. The damage reducing structure 115 is intended to isolate pedestal 108 from the flexible circuit bonding surface 112. The damage reducing structure 115 also reduces damage caused to a semiconductor chip mounted on the pedestal by limiting shock forces, vibrations, and the like that are transmitted through the body 102 to the chip mounting surface 110 and the chip that is mounted there.

In this particular case, the damage reducing structure 115 is a void space or air space that separates the perimeter edge of the pedestal 108 from the flexible circuit bonding surface 112. By disassociating or isolating the pedestal 108 from the surrounding structure, forces traveling through the body as a result of a drop or impact, for example, are reduced or eliminated before they reach the chip mounted on the pedestal. The chip is less likely to be damaged by these forces. In the prior art structures shown in 1-4, shock waves and the like can easily travel from the body and directly into the chip and the adhesive bond connecting the chip to the chip mounting surface. However, as shown best in FIG. 4, shock waves flowing through the body 102 cannot flow directly to the chip mounting surface 110 and, therefore, to the chip mounted on that surface. As a result of the isolation of the pedestal 108 from the surrounding structure, those shock waves have only one pathway to the chip. Shock waves must pass up through the pedestal 108 before reaching the chip mounted thereon. This indirect pathway greatly reduces damage to the chip and may even prevent damage to the chip entirely.

In other embodiments, the space between the perimeter edge of the pedestal 108 and the flexible circuit bonding surface 112 may not be simply a void space. Instead, the damage reducing structure 115 may be a compressible material that limits the transmission of shock forces from the flexible circuit bonding surface 112 to the pedestal 108. Although the space may be filled, it is still important to reduce the forces acting on the chip in order to avoid damage to the chip. For example, one material that may serve as a suitable damage reducing structure 115 is a corrosion resistant compressible member such as a silicone rubber.

In addition to isolating the pedestal 108 from the surrounding flexible circuit bonding surface 112, in certain embodiment, damage to the chip may be further reduced by replacing the normally solid or continuous flexible circuit bonding surface with a ribbed structure. As mentioned above, the chip is often surrounded on all sides by the body after being inserted into the chip pocket. In the past, the chip and the chip pocket were in substantially continuous contact with one another. This allowed shock forces to be very easily transmitted to the chip. Additionally, due to the differences in CTEs, the application of heat during the adhesive bonding process caused the body to expand and contract at a higher rate than the chip, which could damage the chip.

In the present device, however, the flexible circuit bonding surface 112 that forms the pocket is made using a number of ribs 114. The ribs 114 provide a convenient location for mounting a flexible circuit. The shape of the ribs 114, including a top surface of the ribs, may vary. However, it is preferable that at least a portion the top surface of the ribs is planar to allow for the flexible circuit to be easily mounted thereon.

It is believed that this ribbed structure reduces the transmission of shock forces from the body 10 to the chip mounting surface 112 and, consequently, to the chip 12 itself. A damage reducing structure 115 may be located between each adjacent pair of ribs 114 to provide even more protection for the chip 12. For example, the damage reducing structure 115 located between each adjacent pair of the plurality of ribs 114 may be a void space. With reference to FIGS. 1 and 2, in the past, the expansion of the body 10 was constrained to expand in a single direction (i.e., into the chip pocket 16) due to the continuous nature of the surface 18 surrounding the chip pocket. The expansion and contraction of the body 10 had a tendency to damage to the chip 12 by placing thermal expansion stresses on the chip 12. However, as shown in FIG. 3-5, since the amount of material forming the flexible circuit bonding surface 112 is reduced, it is believed that the strength of the expanded material is reduced. Reducing the strength of the plastic holding the chip allows the chips strength to dominate and reduces the likelihood that the chip will be damaged whenever the body expands and contracts, such as during the bonding process.

Reducing the amount of material that forms the flexible circuit bonding surface 112 has advantages, as discussed above, but reducing the amount of material too much may cause problems. For example, it is believed that eliminating too much material from the flexible circuit bonding surface 112 might cause it to be weakened such that it cannot provide adequate support for the flexible circuit during manufacturing or during use. Additionally, the flexible circuit bonding surface 112 provides some support to pedestal 108. If the pedestal 108 were completely isolated and extended up from the nosepiece 104 without any surrounding structure, it is believed that the likelihood of damage to the chip would increase. For these reasons, some minimum amount of material surrounding the pedestal 108 is recommended. For example, in some embodiments, there are at least three ribs located adjacent each side of the pedestal 108 and at least two ribs located adjacent each end of the pedestal. However, more or fewer ribs 114 may be used.

In addition to changing the number of ribs 114 present, varying the thickness Y, height and length X, and orientation of the ribs 114 may allow for the amount of material to be varied, as desired while maintaining sufficient strength. As shown in FIG. 4, the thickness Y of the ribs 114 may vary and multiple thicknesses may be used to form the flexible circuit bonding surface 112. Similarly, the orientation of the ribs 114 may vary. In certain embodiments, the angle $\Theta$ between a first rib and a second rib may be greater than 0° and less than 180°. In other embodiments, $\Theta$ is greater than 45° and less than 135°. In the embodiment shown in FIG. 4, the ribs located along the opposing sides of the pedestal 108 are at approximately right angles to the ribs located along opposing ends of the pedestal, such that $\Theta$ is approximately 90°.

It is contemplated, and will be apparent to those skilled in the art from the foregoing specification that modifications and/or changes may be made in the embodiments of the invention. Accordingly, it is expressly intended that the foregoing are only illustrative of the preferred embodiments and are not limiting thereto and that the true spirit and scope of the present invention be determined by reference to the appended claims.

What is claimed is:

1. A fluid ejection head comprising: a fluid supply body having a nosepiece with at least one fluid supply port formed therein; a pedestal extending outwards from an exterior surface of the nosepiece proximate the at least one fluid supply port, the pedestal having perimeter edge and having a semiconductor chip mounting surface formed within the perimeter edge; a flexible circuit bonding surface extending outwards from an exterior surface of the nosepiece adjacent the perimeter edge of the pedestal, but not in contact with the perimeter edge of the pedestal, wherein the flexible circuit bonding surface comprises a plurality of ribs and a damage reducing structure located between each adjacent pair of the plurality of ribs; and a damage reducing structure located between the perimeter edge of the pedestal and the flexible circuit bonding surface for reducing damage to a semiconductor chip mounted on the pedestal.

2. The fluid ejection head of claim 1 wherein the damage reducing structure is a void space separating the perimeter edge of the pedestal and the flexible circuit bonding surface.

3. The fluid ejection head of claim 1 wherein the damage reducing structure comprises a corrosion resistant compressible member.

4. The fluid ejection head of claim 3 wherein the corrosion resistant compressible member comprises a silicone rubber or other elastomer.

5. The fluid ejection head of claim 1 wherein the pedestal has opposing side surfaces and opposing end surfaces and wherein the flexible circuit bonding surface is disposed adjacent each of the side and end surfaces of the pedestal.

6. The fluid ejection head of claim 1 wherein the damage reducing structure located between each adjacent pair of the plurality of ribs is a void space.

7. The fluid ejection head of claim 1 wherein the pedestal has opposing side surfaces and opposing end surfaces and wherein at least three ribs are located adjacent each side and at least two ribs are located adjacent each end of the pedestal.

8. The fluid ejection head of claim 1 wherein the plurality of ribs comprises a substantially planar top surface forming the flexible circuit bonding surface.

9. The fluid ejection head of claim 1 wherein the plurality of ribs comprises ribs having a first length and ribs having a second length.

10. The fluid ejection head of claim 1 wherein the plurality of ribs comprises a first rib and a second rib that is oriented at an angle Θ with respect to the first rib, wherein Θ is greater than 0° and less than 180°.

11. The fluid ejection head of claim 10 wherein Θ is greater than 45° and less than 135°.

12. The fluid ejection head of claim 1 wherein the semiconductor chip mounting surface is dog-bone shaped.

13. A method for reducing damage to a semiconductor chip attached to a nosepiece of a fluid supply body having at least one fluid supply port, the method comprising the steps of: providing a pedestal extending outwards from an exterior surface of the nosepiece, the pedestal having perimeter edge and having a semiconductor chip mounting surface formed within the perimeter edge; providing a flexible circuit bonding surface extending outwards from the exterior surface of the nosepiece adjacent the perimeter edge of the pedestal, but not in contact with the perimeter edge of the pedestal, wherein the flexible circuit bonding surface comprises a plurality of ribs and a damage reducing structure located between each adjacent pair of the plurality of ribs; providing a damage reducing structure between the perimeter edge of the pedestal and the flexible circuit bonding surface for reducing damage to a semiconductor chip attached to the pedestal; and adhesively attaching a semiconductor chip to the semiconductor chip mounting surface.

14. The method of claim 13 wherein the damage reducing structure is a void space separating the perimeter edge of the pedestal and the flexible circuit bonding surface.

15. The method of claim 13 wherein the pedestal has opposing side surfaces and opposing end surfaces and wherein the flexible circuit bonding surface is disposed adjacent each of the side and end surfaces of the pedestal.

16. The method of claim 13 wherein the damage reducing structure located between each adjacent pair of the plurality of ribs is a void space.

17. The method of claim 13 wherein the plurality of ribs comprises a first rib and a second rib that is oriented at an angle Θ with respect to the first rib, wherein Θ is greater than 0° and less than 180°.

18. The method of claim 13 wherein the plurality of ribs comprises ribs having a first length and ribs having a second length.

* * * * *